US007600449B2

(12) United States Patent
Huang et al.

(10) Patent No.: US 7,600,449 B2
(45) Date of Patent: Oct. 13, 2009

(54) POWER ADJUSTABLE WRENCH

(75) Inventors: Zhonghua Huang, Yuyao (CN); Yeqing Tian, Yuyao (CN); Jiaming Zou, Yuyao (CN); Wenjiang Zhu, Yuyao (CN)

(73) Assignee: Ning Bo Great Wall Precison Industrial Co., Ltd., Yuyao, Zhejiang Province (CN)

( * ) Notice: Subject to any disclaimer, the term of this patent is extended or adjusted under 35 U.S.C. 154(b) by 0 days.

(21) Appl. No.: 12/184,559

(22) Filed: Aug. 1, 2008

(65) Prior Publication Data

US 2009/0056508 A1 Mar. 5, 2009

(30) Foreign Application Priority Data

Aug. 31, 2007 (CN) ..... 2007 1 0070669
Mar. 6, 2008 (CN) ..... 2008 2 0083891 U

(51) Int. Cl.
*B25B 21/00* (2006.01)
*B25B 13/16* (2006.01)

(52) U.S. Cl. ..... 81/57.14; 81/165

(58) Field of Classification Search ..... 81/57.14, 81/165, 170, 57, 54, 57.21, 155, 57.54; 173/216, 173/217

See application file for complete search history.

(56) References Cited

U.S. PATENT DOCUMENTS

| | | | | |
|---|---|---|---|---|
| 4,512,221 | A * | 4/1985 | Picone | 81/170 |
| 5,178,046 | A * | 1/1993 | Matsumoto et al. | 81/57.14 |
| 6,267,026 | B1 * | 7/2001 | Yamamoto | 81/54 |
| 7,114,824 | B2 * | 10/2006 | Picone | 81/170 |
| 7,263,916 | B1 * | 9/2007 | Wu | 81/57.14 |
| 2008/0000332 | A1 * | 1/2008 | Wu | 81/170 |

* cited by examiner

*Primary Examiner*—Hadi Shakeri
(74) *Attorney, Agent, or Firm*—Global IP Services; Tianhua Gu

(57) ABSTRACT

An electric adjustable spanner comprises a spanner body, an adjustable jaw, a driving control circuit including an electromotor, a power supply, a switch and a gear transmission mechanism. the switch is a switch for controlling positive and reverse rotation of the electromotor. The switch comprises a button with two return springs at both ends respectively; the button has two parallel conductive contact blocks on the bottom of the button. A circuit board having metal foils on face and back sides thereof is located under the conductive contact blocks. The face metal foil forms a pair of output contact pieces, a pair of input contact pieces and a pair of transmission pieces at the lower part, and a pair of input terminals is riveted on the side of the circuit board against the button. When the button moves upward the output is positive and when the button moves downwards the output is reverse.

7 Claims, 8 Drawing Sheets

POWER ADJUSTABLE WRENCH

CROSS REFERENCE TO THE RELATED PATENT APPLICATION

This patent application claims the priorities of the Chinese patent application No. 200710070669.8, filed on Aug. 31, 2007 and Chinese patent application No. 200820083891.1, filed on Mar. 6, 2008, which are incorporated herein by reference.

FIELD OF THE INVENTION

This invention relates to a power adjustable wrench, and more particular to an electric adjustable wrench that can be driven by electromotor to adjust the size of jaw.

BACKGROUND OF THE INVENTION

An ordinary adjustable wrench includes the wrench body and an adjustable jaw, a fixed jaw is provided at the front end of the wrench body, the fixed jaw is connected with adjustable jaw to form the size of jaw that can be adjusted, a worm is provided at the bottom of the adjustable jaw to drive the adjustable jaw back and forth, the jaw can be moved back forth by screwing the worm with your thumb. This structure has the following deficiencies in practical application: First, the fingers cannot access screw caps in some special locations of machines, or even if the fingers can access them, the operation locations will obstruct the line of sight, which may cause inconvenience for manual operation and result in improper size of jaw, leading to permanent damage of screws; second, manual operation has limited force and needs space for operation, during the design, problems like excessive interval between the worm and the adjustable jaw may be caused, which may cause the damage of the screw cap corners and make them incapable of being screwed, resulting in losses and troubles; finally, manual operation needs great efforts and has poor effect, which will greatly impact the working efficiency.

Therefore, a lot of electric adjustable wrench have been produced, they adopt electromotor driving as substitute of manual driving to drive the worm to rotate, please refer to Chinese Utility Model Patent: ZL200520074217.3, which disclosed a kind of "Electric Spanner" (Disclosure No.: CN2855649Y), which comprises a jaw and an adjusting nut and is featured by that a reduction electromotor is provided in the main body below said adjusting nut with a said adjusting nut, the gear connected to the rotation axis end of said reduction electromotor is engaged with a gear connected to one end of said adjusting nut, chargeable batteries are provided in the cavity in the handle of said spanner, said batteries are connected with the charging circuit, said batteries are connected to said electromotor through the staggered paralleled double-pole-double-throw button control circuit. This design needs to be improved in the following aspects: first, because the electromotor is vertical to the length of the spanner, the head of the spanner is too large to be used conveniently; second, although the reduction gear set is provided, the electromotor still rotates at high speed, during fast driving, the driving force is insufficient and the driving is not stable; third, during fast driving, the worm may be damaged without a buffering device, which may influence the service life of the electromotor; fourth, too fast speed will result in small force, when screwing the screw cap, it will be flexible. There is a similar patent: CN1868684A, which provided a limit pin, however, the advancing speed of the worm is still high and the head of the spanner is inevitably large.

Please refer to U.S. Pat. No. 6,477,921, which disclosed an electric adjustable wrench, which drives the worm by an electromotor via a belt or chain, however, due to the excessive rotating speed of the electromotor, the problems above still cannot be avoided, similarly, there are U.S. Pat. Nos. 6,966,242 and 4,512,221, because the belts and chains require large space of installation and are easily damaged, the electromotor needs to have high efficiency with a small size, which may cause increase of the cost.

As a further improvement, Chinese utility model patent No.: ZL200520014295.4, which disclosed an electric adjustable wrench (Disclose No.: CN2834793Y), which provides a wrench whose handle is provided with a battery seat for receiving batteries, a DC electromotor is equipped in the front part of said battery seat is provided with, the shaft of said electromotor extends forward and is connected with a rotating shaft with a gear at the end through a bevel gear; said bevel gear is connected encloses the shaft of said electromotor, a further improvement, said bevel gear is provided with a supporting spring at the rear part to push said rotating shaft; a contact cut-off switch serially connected with the power circuit is provided beside said supporting spring is provided. In this patent, said electromotor is provided inside the spanner wrench and parallel to the length of the wrench body and is driven by the bevel gear, which make the head of the wrench body compact (U.S. Pat. No. 7,114,824 provides a similar structure); the supporting spring works as the buffering device, which reduces the abrasion of internal mechanical structures. Though great improvement has been made, the advancing speed of the worm is still too high, as the output power of said electromotor is rated, the force is still insufficient, and when screwing the screw cap, the worm is still subject to looseness; the electromotor produces large noise during the driving, and further improvements can be made.

SUMMARY OF THE INVENTION

The technical problem for this invention to solve is to provide a power adjustable wrench with reducing gear transmission, stable adjustable jaw and without buffering device or high production cost.

To solve the aforesaid technical problems, this invention adopts the technical solutions as follows: a power adjustable wrench comprising a wrench body, an adjustable jaw, an electromotor, a power supply, a switch and a gear transmission mechanism, a fixed jaw being provided at the front end of the wrench body, the fixed jaw being connected with the adjustable jaw to form a adjustable jaw space, the adjustable jaw having worm gear teeth on the bottom thereof to engage with a worm for driving the adjustable jaw back and forth, an output end of the gear transmission mechanism being connected with the worm, an electromotor, power supply and switch forming a driving control circuit, the gear transmission mechanism being a gear reducer with at least three pairs of reduction gears.

As optimization, the said transmission range of said gear reducer is from 10:1 to 30:1, ensuring the adjustable jaw to obtain satisfactory and ideal thrust and moving speed at the speed of the electromotor is reduced.

As optimization, the said gear reducer comprises a first couple of coaxial gears including a second bevel gear and a third gear both connected by a rotor shaft, a second couple of coaxial gears including a forth gear and a fifth gear, and a worm gear; the electromotor which is inside the wrench body and is parallel to the length direction of the wrench body has a first bevel gear fixed with a driving a shaft of the electromotor; the first bevel gear is in gear with the second bevel gear, the third gear is in gear with the forth gear, the fifth gear is in gear with the worm gear. It is the compact structure and small size and ensures easy installation.

As a further improvement, the said rotor shaft is ratably fixed on a bracket inside the wrench body, the second couple of coaxial gears is ratably assembled at a minor axis hole on an inner wall of the wrench body by a minor axis, the worm integrates with the worm gear via a major axis and is rotatably assembled at the major axis hole on the inner wall of said wrench body, which facilitates the production and assembly.

Of course, a 4-pair gear reduction unit is also applicable; however, this may increase the installation dimensions, so the 3-pair is preferred.

As a further improvement, the wrench body comprises the main body, an upper cover and a lower cover for enclosing the gear transmission mechanism, electromotor and the switch of the power supply, the main body is provided with a front through hole for containing the electromotor and gear transmission mechanism and a rear through hole for containing the switch and the power supply, the minor axis hole is equipped at the front end of the upper cover, which facilitates the production and assembly.

As a very beneficial improvement, the switch is a switch for controlling positive and reverse rotation of the electromotor, which comprises a button with two return springs at both ends respectively, the button has two parallel conductive contact blocks on the bottom of the button, a circuit board having metal foils on face and back sides thereof is located under the conductive contact blocks, the face metal foil forms a pair of output contact pieces at the upper part, a pair of input contact pieces at the middle and a pair of transmission pieces at the lower part, which are arranged in parallel, while a pair of input terminals are riveted on the side of the circuit board against the button, the back metal foil forms a pair of connecting pieces for connecting the pairs of input terminals with said pair of input contact pieces, forms a pair of connecting pieces for reverse switching connection of the transmission contact pieces with the output contact pieces, allowing an output to be positive when the button moves upwards and an output to be reverse when the button moves downwards. This structure makes the switch very light and thin, appliable to be installed in the long and narrow space inside the spanner body, it is easily assembled and produced low cost.

As an improvement, said button is provided with a flange on the bottom, which is connected with conductive contact blocks, said button is provided with a raised line to facilitate pressing on the surface.

Finally, said power supply adopts dry batteries, rechargeable batteries or solar batteries, correspondingly, said wrench body is provided with a charger socket or solar panels on the surface.

Compared with existing technologies, this invention has advantages as follows: compact structure, compact arrangement of gear transmission mechanism, small size, low cost of manufacture, allowing the application of speed change gear with three pairs of reduction or more pairs in the long and narrow through hole, which makes the advancing speed of the adjustable jaw optimized, the revolutions of the electromotor reduced and the electric work efficiency improved, the moving speed is stable with low noise, one end of the worm is fixed when the worm is rotated to the end, no buffering mechanism is required; the circuit adopts the switch for positive and reverse rotation, which can change the rotation direction of the electromotor, moreover the switch can only be powered on with external force, which avoids damages of the device due to certain mistaken operations, its light and thin structure facilitates the operation and installation and lowers the cost.

DETAIL DESCRIPTION OF THE INVENTION

Detailed description of this invention will now be described with reference to the drawings.

Figure 1:
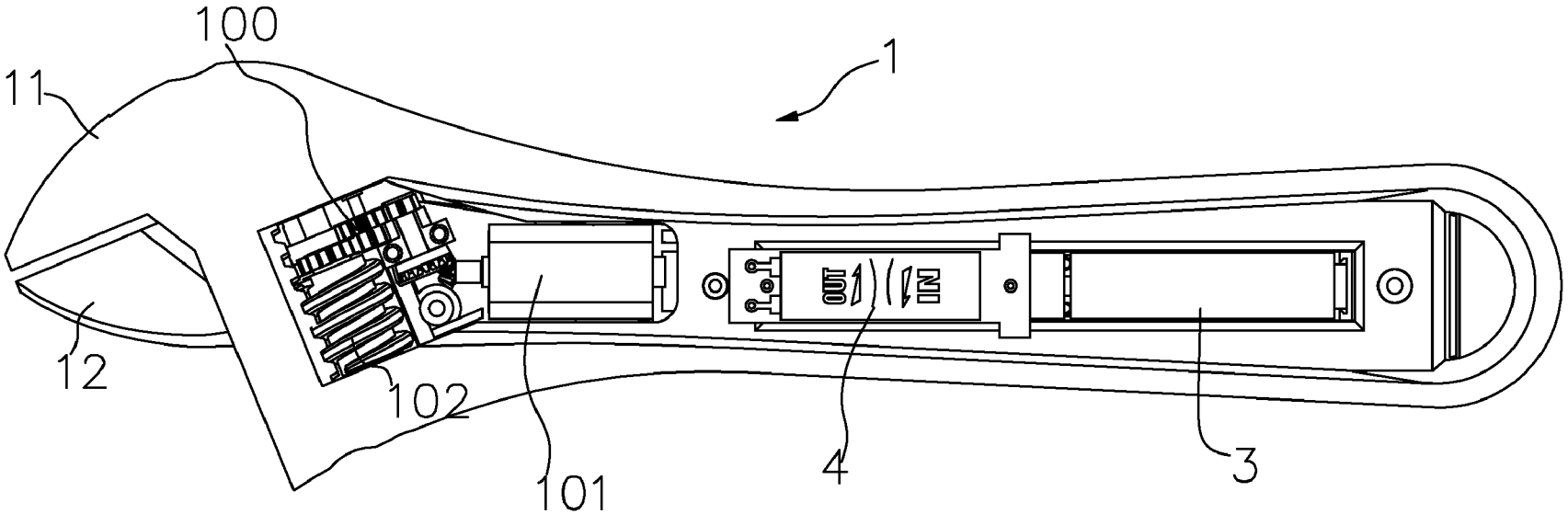
FIG. 1 is the schematic diagram of the embodiment without the upper cover.
Figure 2:
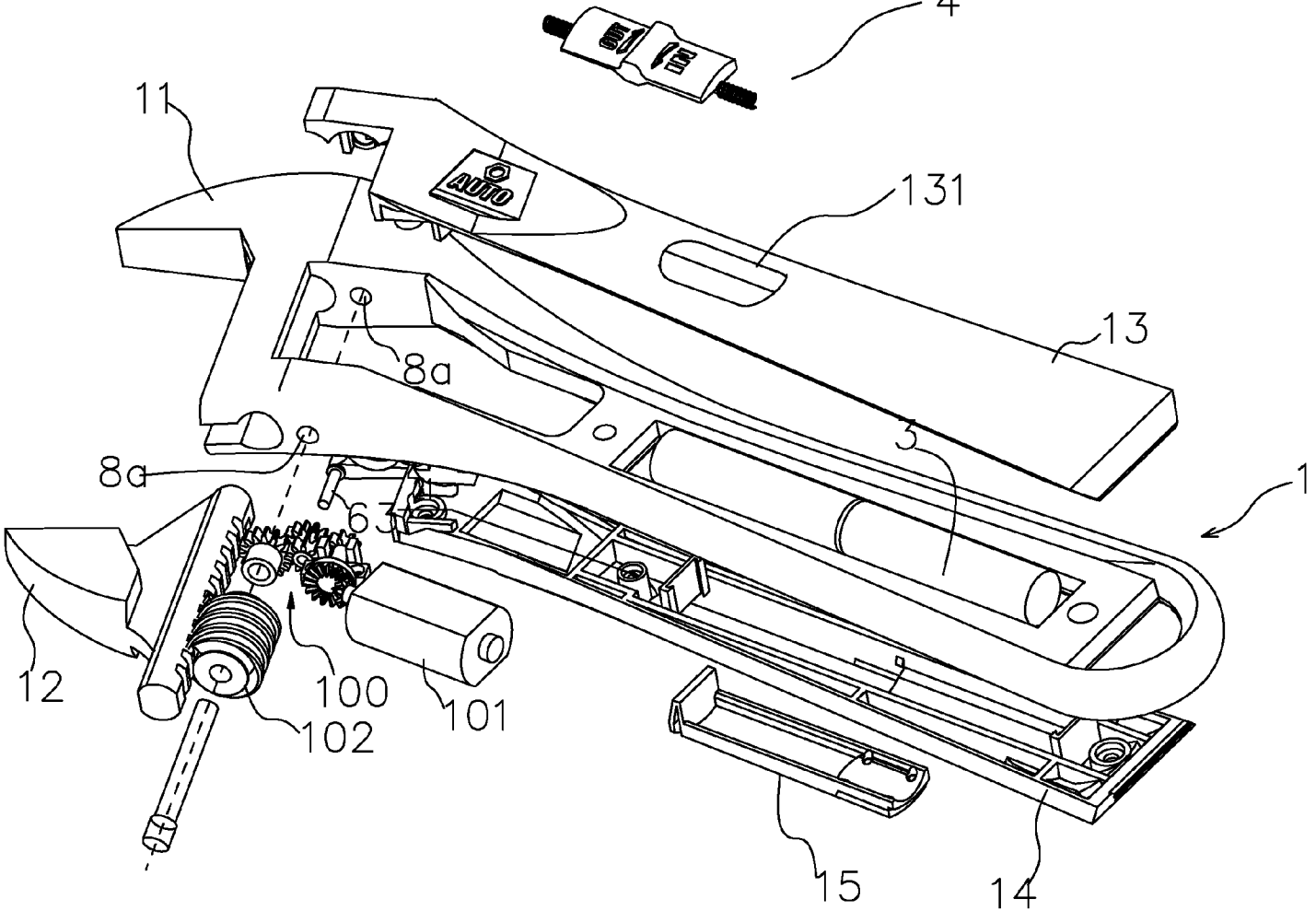
FIG. 2 is the exploded view of the embodiment.

Embodiment see FIG. 1 and FIG. 2, the power adjustable wrench according to this embodiment also comprises: the wrench body 1, the adjustable jaw 12, the electrometer 101, the power supply 3, the switch 4 and the gear transmission mechanism 100, a fixed jaw 11 being provided at the front end of the wrench body 1, said fixed jaw 11 is connected with said adjustable jaw 12 to form the size of jaw that can be adjusted, the worm gear at the bottom of said adjustable jaw 12 is engaged with the worm 102 to drive said adjustable jaw 12 back and forth, the output end of said gear transmission mechanism 100 is engaged with said worm 102 and said electromotor 101, power supply 3 and switch 4 form the driving control circuit, this embodiment adopts dry batteries or solar cells as the power supply 3, when solar cells are used, the solar energy panel should be installed on the surface of said wrench body 1.

Figure 3:
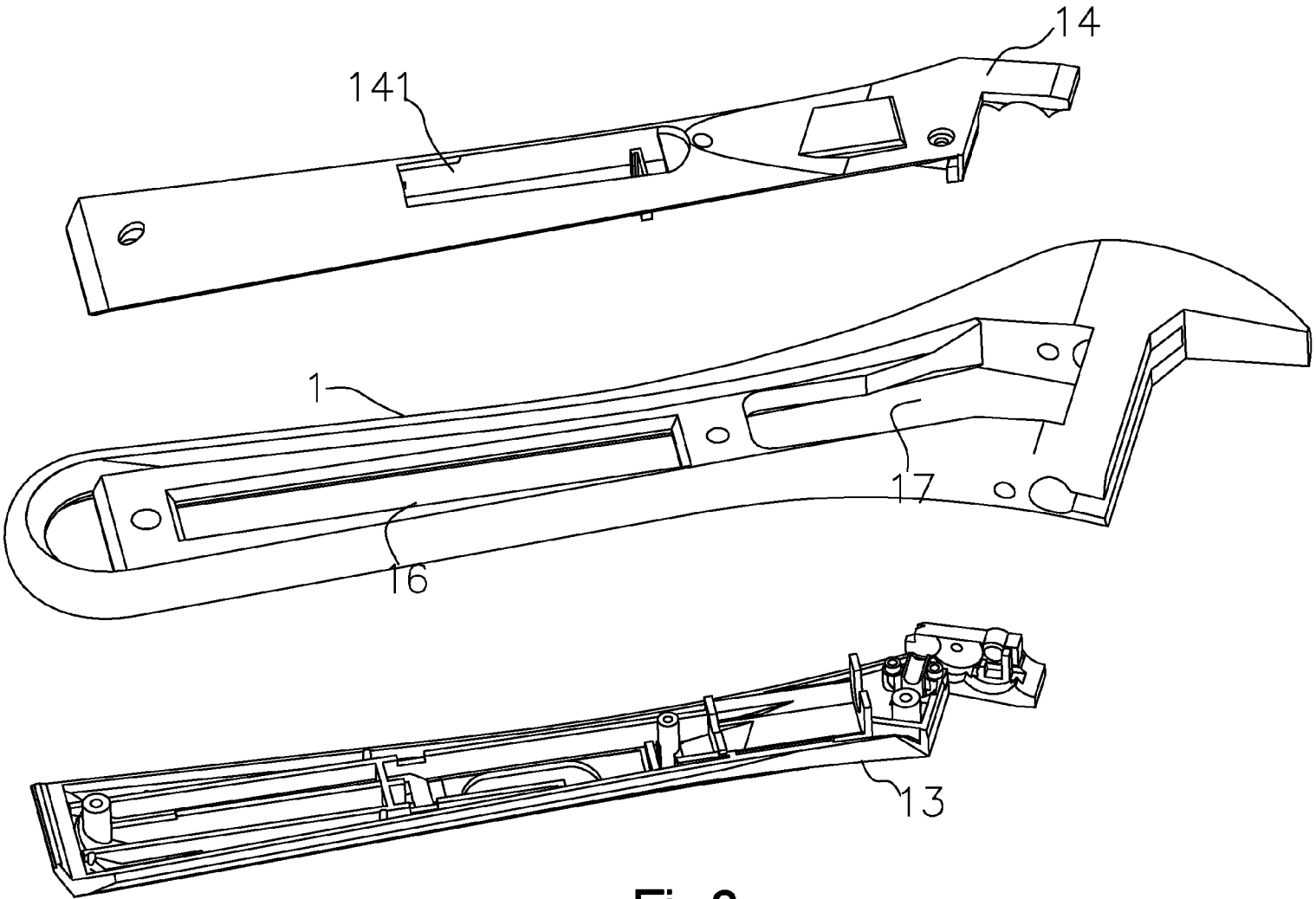
FIG. 3 is the exploded view of the upper cover and the lower cover.
Figure 4:
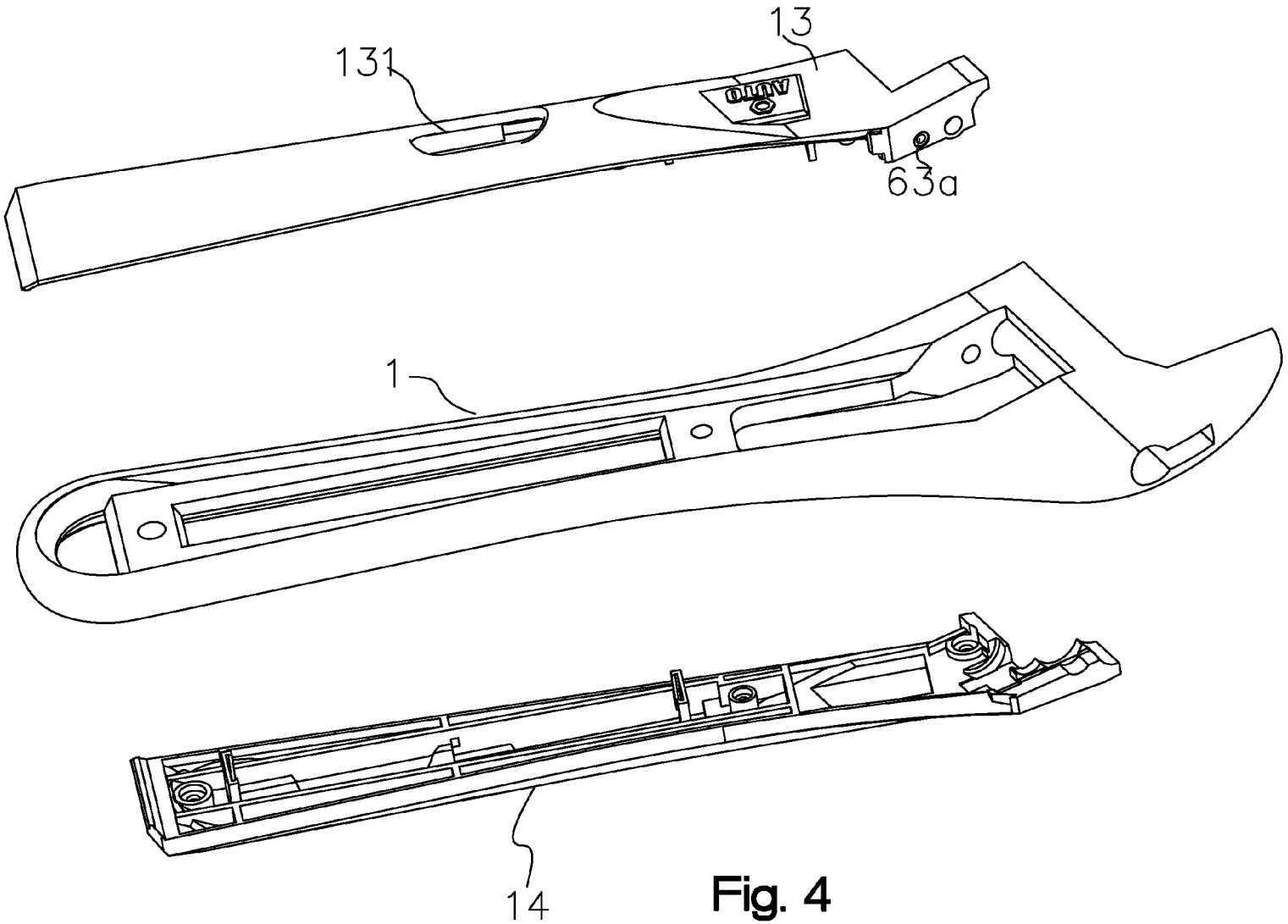
FIG. 4 is the exploded view of the upper cover and the lower cover from another angle.

See FIG. 3 and FIG. 4, the wrench body 1 comprises the main body 1*a*, the upper cover 13 and the lower cover 14, said main body 1*a* is equipped with the front through hole 17 for containing the gear transmission mechanism 100 and the electromotor 101 and the rear through hole 16 for containing the switch 4 and the power supply 3, said upper cover 13 is equipped with through hole 131 for the switch button 41 to move, said lower cover 14 is equipped with an installation hole 141 for installing the battery cover, and said battery cover 15 is installed in said installation hole 141, said upper cover 13 and said lower cover 14 can both be made of plastic and be fixed to the main body with screws, allowing said gear transmission mechanism 100, electrometer 101, said switch 4 and said power supply 3 to be enclosed in said wrench body 1.

Figure 5:
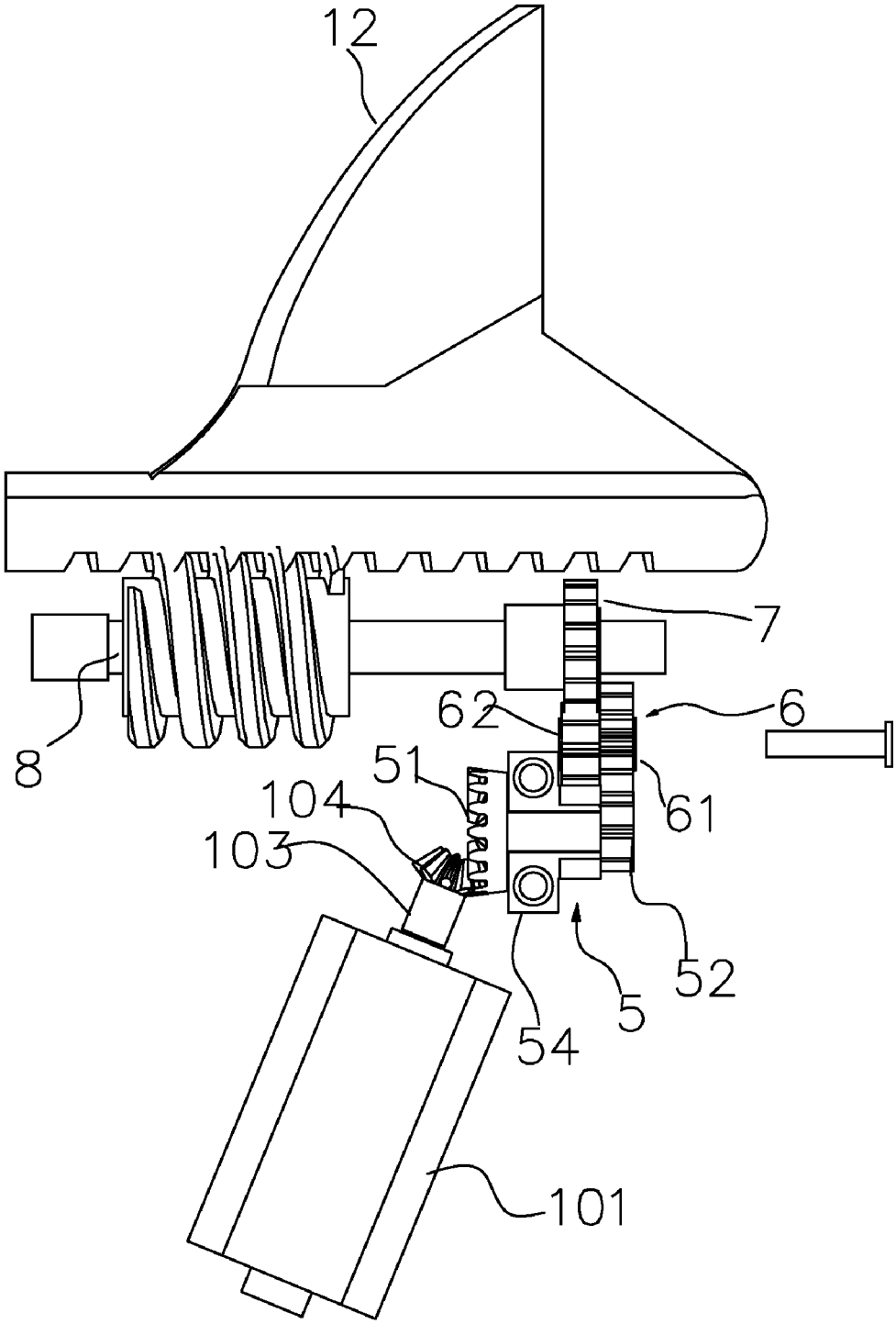
FIG. 5 is the partially enlarged view of the embodiment.
Figure 6:
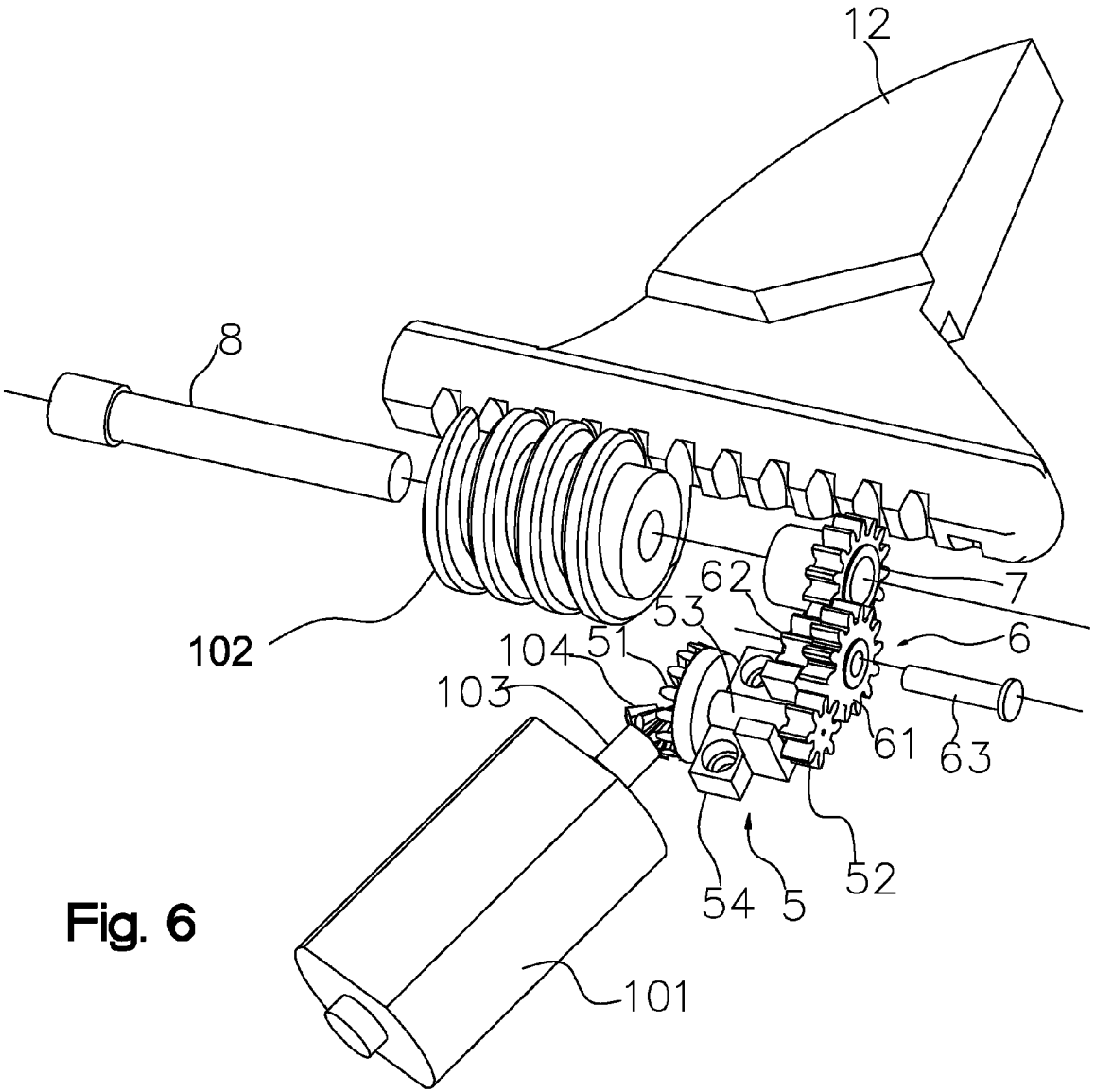
FIG. 6 is the 3D view of the transmission mechanism.
Figure 7:
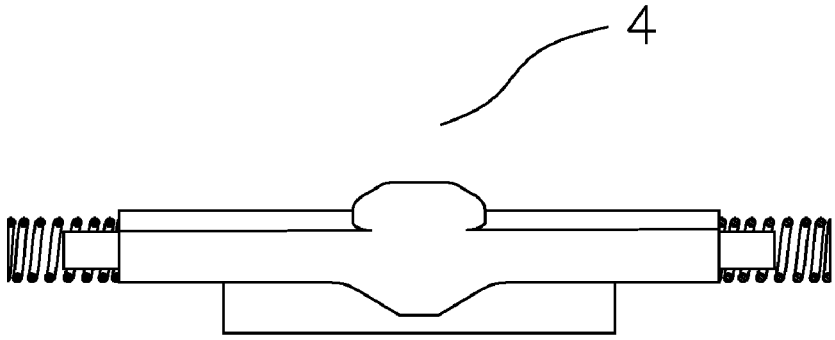
FIG. 7 is the side view of the switch.
Figure 8:
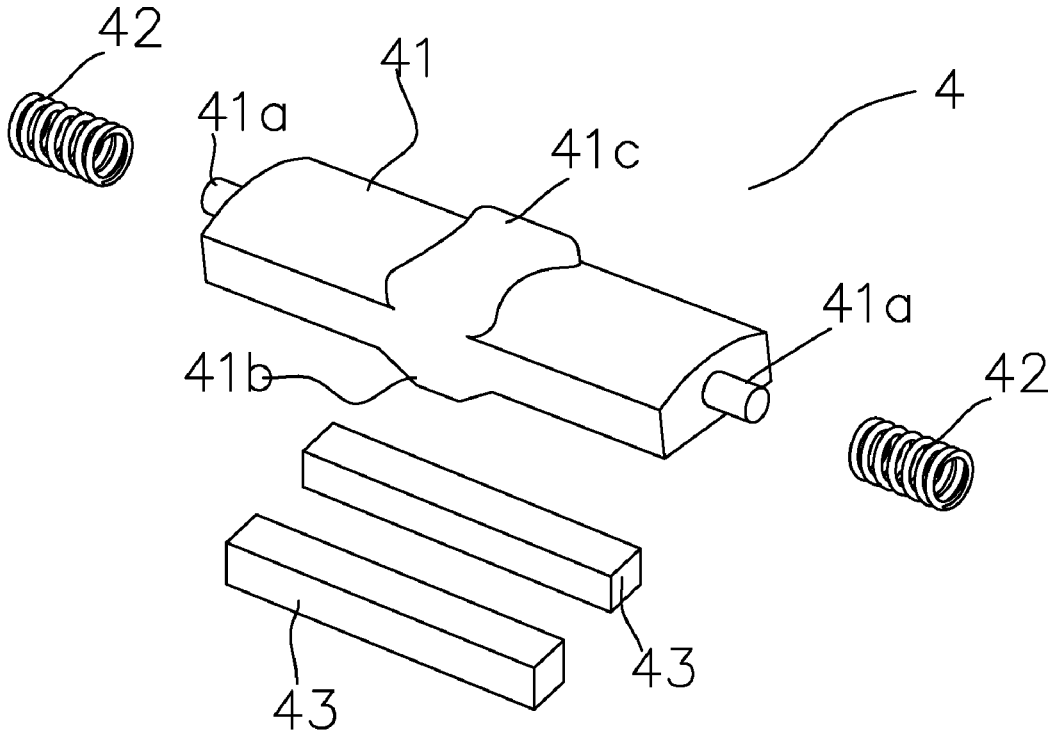
FIG. 8 is the 3D exploded view of the switch.

See FIG. 5, the gear reduction unit has 3 pairs of reducing gears with a transmission range from 10:1 to 30:1. The electromotor 101 is installed inside the wrench body 1 and parallel to the length of the wrench body 1, the first bevel driving gear 104 is mounted at the end of the electromotor shaft 103. The gearing transmission further comprises first couple of coaxial gears 5, second couple of coaxial gears 6 and worm gear 7.

The first couple of coaxial gears 5 comprises the second bevel driven gear 51 engaged with the first bevel driving gear 104, the second bevel driven gear 51, the third small gear 52 and their connecting rotor shaft 53 form the first couple of coaxial gear 5. The rotor shaft 53 is pivotally mounted on a bracket 54 inside the wrench body 1, making the first couple of coaxial gear 5 fixed in the front through hole 17.

The second couple of coaxial gears 6 is a stepped in-line transmission gear which comprises the fourth gear and the fifth gear. The fourth gear is a front transmission gear 61 and the fifth gear is rear transmission gear 62. The front transmission gear 61 engaged with the third small gear 52 and the rear transmission gear 62 connected with said front transmission gear 61 by duplex, the second couple of coaxial gear 6 rotatably fixed at the minor axis 63*a* on the inside wall of the wrench body 1 via a minor axis 63 (see FIG. 4), more specifically, said minor axis hole 63*a* is located at the front end of the upper cover.

A worm gear 7 rotates coaxially with the worm 102 and is engaged with the rear transmission gear 62, said worm 102 is integrated with said worm gear 7 via a major axis 8 and ratably fixed on the major axis hole 8*a* on the inside wall of said wrench body.

See FIGS. 6-11, the switch 4 is the 2-way switch for controlling the electromotor to rotate positively and reversely, it is mounted in the through hole 131 on the upper cover 13 of the rear through hole 16 of the main body, said switch 4 comprises a button 41, protrusions 41*a* extends from both ends of said button 41, returns springs 42 wind around said protrusions 41*a*, one end of each return spring is against the inner wall of said through hole 131, allowing said button 41 to move inside said through hole 131 back and forth, said switch forms a flange 41*b* forms at the bottom and a raised line 41C to facilitate applying force and thrust on the top. 2 conductive contact blocks 43 are mounted on the bottom of said switch in parallel, they can be fixed with said flange 41*b* at the bottom of said switch with conductive rubber or graphite stripes, correspondingly, a circuit board 44 with bifacial metal foils faces one side of said button 41, said circuit board 44 forms a pair of output contact pieces 44*a* on the upper part, a pair of input contact pieces 44*b* on the middle and a pair of transmission pieces 44*c* on the lower part, which are arranged in parallel for facilitating manufacture, while a pair of input terminals 44*d* are riveted on the side of the circuit board 44 against the button 41, said metal foils form a pair of connecting pieces 44*e* for connecting the pairs of input terminals with said pair of input contact pieces, said metal foils also form a pair of connecting pieces 44*f* for reverse switching connection of said transmission contact pieces 44*c* with said output contact pieces 44*a*, a pair of output contact pieces 44*a* are connected with the input terminals of the electromotor via connection and the pair of input terminals 44*d* are connected to the batteries via connection, which then forms the control circuit.

Figure 9:
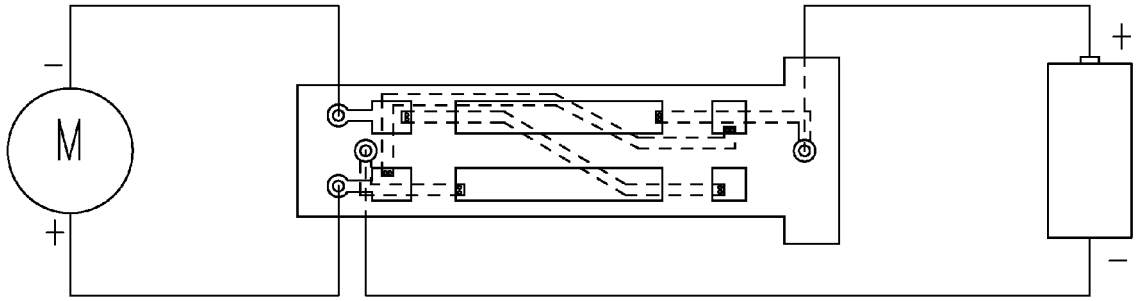
FIG. 9 is the schematic circuit diagram.
Figure 10:
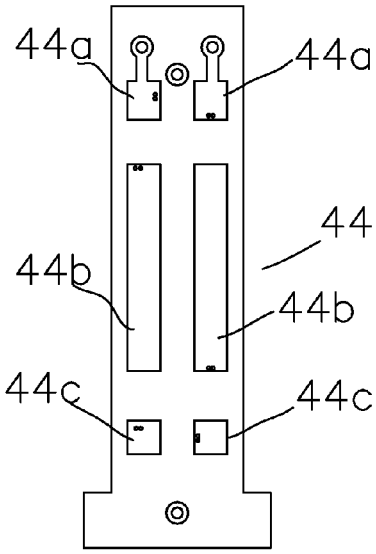
FIG. 10 is the front view of the circuit.
Figure 11:
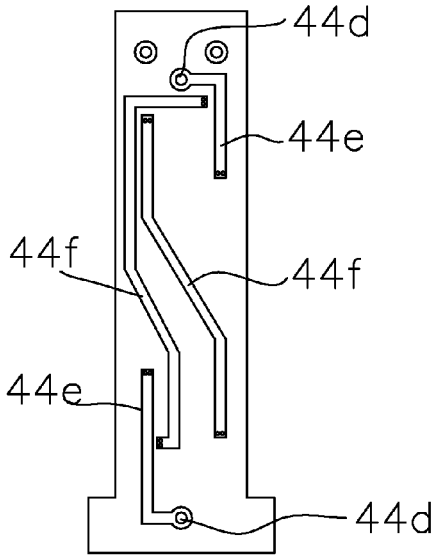
FIG. 11 is the back view of the circuit.

The working principles are as follows: When said switch button 41 moves upwards with the push of hand, the conductive contact blocks 43 on the bottom of said button will move upwards, connecting the input contact pieces 44*b* on the circuit board with the output contact pieces 44*a* so as to constitute the circuit, at this time, the electromotor is connected to positive voltage, and the electromotor 101 rotates positively, through the 3-pair gear reduction unit and the worm wheel and worm mechanism, making the adjustable jaw 12 move inwards to reduce the size of jaw of the spanner, contrarily, when the switch button 41 moves downwards with the push of the hand, the conductive contact blocks 43 on the bottom of the button will move downwards, connecting the input contact pieces 44*b* on the circuit board with the transmission contact pieces 44*c*, while said transmission contact pieces 44*c* switch the voltage reversely through the connecting pieces 44*e* on the back of the circuit board and then be connected to the output contact pieces 44*a* to constitute the circuit, at this time, said electromotor 101 is connected to the reverse voltage and the electromotor rotates reversely, through the 3-pair gear reduction unit and the worm wheel and worm mechanism, making the adjustable jaw 12 move outwards to increase the size of jaw of the wrench, while when the switch button 41 is at the middle, the conductive contact blocks 43 on the bottom of the button is also at the middle, which prevents said output contact pieces 44*a* from being connected with said input contact pieces 44*b*, as no circuit will be constituted, the electromotor is not powered on and will not work, FIG. 9 is an optimized circuit schematic diagram of this embodiment, in which when the button 41 is moving forward or backwards, the rotation direction of the electromotor 101 is reverse. Of course, other layout diagrams are also applicable once they meet the requirement that after installing the switch of this embodiment, the positive and reverse rotation of the electromotor 101 can be achieved.

What is claimed is:

1. A power adjustable wrench comprising a wrench body, an adjustable jaw, a driving control circuit including an electromotor, a power supply, a switch and a gear transmission mechanism, a fixed jaw being provided at the front end of the wrench body, the fixed jaw being connected with the adjustable jaw to form a adjustable jaw space, the adjustable jaw having worm gear teeth on the bottom thereof to engage with a worm for driving the adjustable jaw back and forth, an output end of the gear transmission mechanism being connected with the worm, the gear transmission mechanism being a gear reducer with at least three pairs of reduction gears; wherein the switch for controlling positive and reverse rotation of the electromotor comprises:

a button with two return springs at two ends respectively, the button has two parallel conductive contact blocks on the bottom of the button;

a circuit board having metal foils on face and back sides thereof is located under the conductive contact blocks;

the face metal foil forms a pair of output contact pieces at the upper part, a pair of input contact pieces at the middle and a pair of transmission pieces at the lower part, which are arranged in parallel, a pair of input terminals are riveted on the side of the circuit board against the button;

the back metal foil forms a pair of connecting pieces for connecting the pairs of input terminals with the pair of input contact pieces, forms a pair of connecting pieces for reversely switch-connecting the transmission contact pieces with the output contact pieces;

thereby, an output is positive when the button moves upwards and an output is negative when the button moves downwards.

2. The power adjustable wrench according to claim 1, wherein the transmission range of said gear reducer is from 10:1 to 30:1.

3. The power adjustable wrench according to claim 2, wherein the gear reducer comprises a first couple of coaxial gears including a second bevel gear and a third gear both connected by a rotor shaft, a second couple of coaxial gears including a forth gear and a fifth gear, and a worm gear; the electromotor which is inside the wrench body and is parallel to the length direction of the wrench body has a first bevel gear fixed with a driving a shaft of the electromotor; the first bevel gear is in gear with the second bevel gear, the third gear is in gear with the forth gear, the fifth gear is in gear with the worm gear.

4. The power adjustable wrench according to claim 3, wherein the rotor shaft is ratably fixed on a bracket inside the wrench body, the second couple of coaxial gears is ratably assembled at a minor axis hole on an inner wall of the wrench body by a minor axis, the worm integrates with the worm gear via a major axis and is rotatable assembled at the major axis hole on the inner wall of said wrench body.

5. The power adjustable wrench according to claim 4, wherein the wrench body comprises the main body, an upper cover and a lower cover for enclosing the gear transmission mechanism, electromotor and the switch of the power supply, the main body is provided with a front through hole for containing the electromotor and gear transmission mechanism and a rear through hole for containing the switch and the power supply, the minor axis hole is equipped at the front end of the upper cover.

6. The power adjustable wrench according to claim 1, wherein the button is provided with a flange on the bottom, which is connected with conductive contact blocks, the button is provided with a raised line to facilitate pushing of the button.

7. The power adjustable wrench according to claim 1, wherein the power supply adopts dry batteries, rechargeable batteries or solar batteries.

* * * * *